US007070360B2

(12) United States Patent
Ellingsen

(10) Patent No.: US 7,070,360 B2
(45) Date of Patent: Jul. 4, 2006

(54) APPARATUS AND METHOD

(75) Inventor: Kjell Einar Ellingsen, Hundvaag (NO)

(73) Assignee: Subsea 7 BV, Rijswijk 2H (NL)

( * ) Notice: Subject to any disclaimer, the term of this patent is extended or adjusted under 35 U.S.C. 154(b) by 0 days.

(21) Appl. No.: 11/046,920

(22) Filed: Jan. 31, 2005

(65) Prior Publication Data

US 2005/0186033 A1 Aug. 25, 2005

(30) Foreign Application Priority Data

Feb. 4, 2004 (GB) ..... 0402428.7

(51) Int. Cl.
*F16L 57/00* (2006.01)

(52) U.S. Cl. ..... 405/157; 405/211

(58) Field of Classification Search ..... 405/157, 405/211, 216

See application file for complete search history.

(56) References Cited

U.S. PATENT DOCUMENTS 3,910,056 A * 10/1975 Dopyera ..... 405/211
4,077,222 A * 3/1978 Larsen ..... 405/157
4,171,174 A * 10/1979 Larsen ..... 405/157
4,519,727 A 5/1985 Mitchell et al.
4,919,210 A * 4/1990 Schaefer, Jr. ..... 166/356
5,052,859 A * 10/1991 Miller ..... 405/157
5,385,430 A * 1/1995 Connors ..... 405/157
5,810,515 A * 9/1998 Fredriksen et al. ..... 405/211
6,889,770 B1 * 5/2005 Qvam et al. ..... 166/356

FOREIGN PATENT DOCUMENTS

WO WO02/075103 A1 9/2002
WO WO03/071092 8/2003
WO WO03/071092 A1 8/2003

* cited by examiner

*Primary Examiner*—Frederick L. Lagman
(74) *Attorney, Agent, or Firm*—Drinker Biddle & Reath LLP

(57) ABSTRACT

The invention provides a protective structure for a subsea installation. The protective structure comprises first and second body portions and a hinge member. The body portions are pivotally mounted to the hinge member such that at least one of the body portions may pivot relative to the other body portion. The body portions occupy a first configuration which facilitates transportation and/or deployment to the seabed and a second configuration in which the body portions are arranged to substantially enclose the subsea installation when the structure has been positioned over it. First and second locking means can lock the structure in the first and the second configuration respectively. Additionally the protective structure can allow access to the subsea installation when in use, by provision of a closable opening.

19 Claims, 3 Drawing Sheets

APPARATUS AND METHOD

FIELD OF THE INVENTION

The present invention relates to protective structures for use with subsea installations utilised in the field of subsea oil and gas recovery operations. More specifically, the present invention relates to a structure for protecting a subsea installation located on the seabed.

BACKGROUND

In order to recover oil and gas from fields located below seabed level, a drilling operation is first undertaken to produce a well. Once the well has been drilled, it is conventional for installation equipment such as valves, for example, to be positioned over, and connected to, the well in order to control the recovery of the oil or gas to the surface. With this type of installation the equipment sits exposed on the seabed, and it is possible for the equipment to be damaged by dropped objects, anchors, trawler nets and other similar hazards. It is therefore advantageous to provide some type of protection for such subsea installations.

Attempts at protecting the installations have included steel framed, fixed geometry structures, which are lowered over the installation by a crane from a supply vessel on the surface. Due to their size and fixed geometry, these structures occupy a significant amount of space on the supply vessel, which normally means that the vessel may only carry one structure at a time. The deployment of these structures can also be restricted in bad weather conditions as a result of the large hydrodynamic forces created by their size and also by their fixed geometry.

In order to attempt to address the problems of such fixed geometry structures, collapsible structures have also been utilised, and such structure is shown in International Patent Publication No WO03/071092. As they are collapsible, the structures can be lowered to the installation site in their collapsed states, before being set up over the installation on the seabed. Although an improvement over fixed geometry structures, these collapsible structures include components such as folding legs and anchors which still restrict the storage possibilities on vessels and also create significant hydrodynamic forces when being lowered to the site. Furthermore, these known fixed and collapsible structures are provided with openings—usually between the legs of the structure—to allow access to the installation equipment. With such openings, there still exists the possibility that one of the subsea hazards previously listed could enter these openings and interfere with and/or damage the installation equipment. This multiplicity of openings can be closed by protective plates or grills, but this adds to the complexity of the design and/or further exacerbates the hydrodynamic loadings during launch.

SUMMARY OF THE INVENTION

According to a first aspect of the present invention there is provided a protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are adapted to substantially enclose the subsea installation when the structure has been positioned over it.

Typically, the first configuration comprises a folded state and the second configuration comprises an unfolded state.

Preferably, both body portions rotate relative to one another when the structure moves from the folded state to the unfolded state.

Preferably, each body portion comprises a base member and at least one side panel, the at least one side panel having a pair of longitudinal edges, and wherein one of the longitudinal edges is fixed to the base member and the other longitudinal edge is fixed to the hinge member.

Preferably, each base member has first and second end portions at respective ends of the base member, the first and second end portions adapted so as to project inwardly from the base member towards the centre of the structure when the structure is in the unfolded state. Preferably, each body portion comprises at least one side panel and first and second end panels, wherein the side panel has a pair of lateral edges and wherein each of the first and second end panels is fixed to a respective lateral edge of the side panel. Each end panel typically has a free edge, and the body portions are adapted such that the free edges of the end panels of the respective body portions abut one another when the structure is in the unfolded state.

Preferably, each base member has a hinged stabiliser plate pivotally attached thereto, each plate adapted to move from a retracted position which is preferably against the structure to a deployed position which is preferably on the seabed.

Preferably, at least one of the body portions has a closable access opening adapted to allow access to the interior of the structure when the structure is in the unfolded state.

Preferably, the base members lie adjacent one another when the structure is in the folded state. Preferably, the side panels lie substantially parallel to one another when the structure is in the folded state. Preferably, the structure further comprises a first locking means for locking the base members together when the structure is in the folded state. Preferably, the structure further comprises at least one second locking means for locking the first and second body portions together when the structure is in the unfolded state.

Preferably, the structure is stored and transported in the folded state.

According to a second aspect of the present invention, there is provided a method of protecting a subsea installation, the method comprising the steps of:

a) pivotally mounting first and second body portions to a hinge member to form a structure wherein at least one of the body portions may rotate relative to the other body portion from a first configuration which facilitates transportation and/or deployment to the seabed, and a second configuration;

b) locking the first and second body portions together such that the structure is in the first configuration;

c) lowering the structure in the first configuration to a position adjacent the seabed;

d) rotating the at least one body portion from the first configuration to the second configuration;

e) locking the structure in the second configuration; and f) lowering the structure in the second configuration over the installation such that the installation is substantially enclosed by the structure.

Typically, the first configuration comprises a folded state and the second configuration comprises an unfolded state.

Preferably, step e) occurs before step f) although step f) could, in certain embodiments, occur before step e).

BRIEF DESCRIPTION OF THE DRAWINGS

A preferred embodiment of the present invention will now be described, by way of example only, with reference to the accompanying drawings, in which.

a)

b)

DETAILED DESCRIPTION OF THE DRAWINGS

Figure 1:
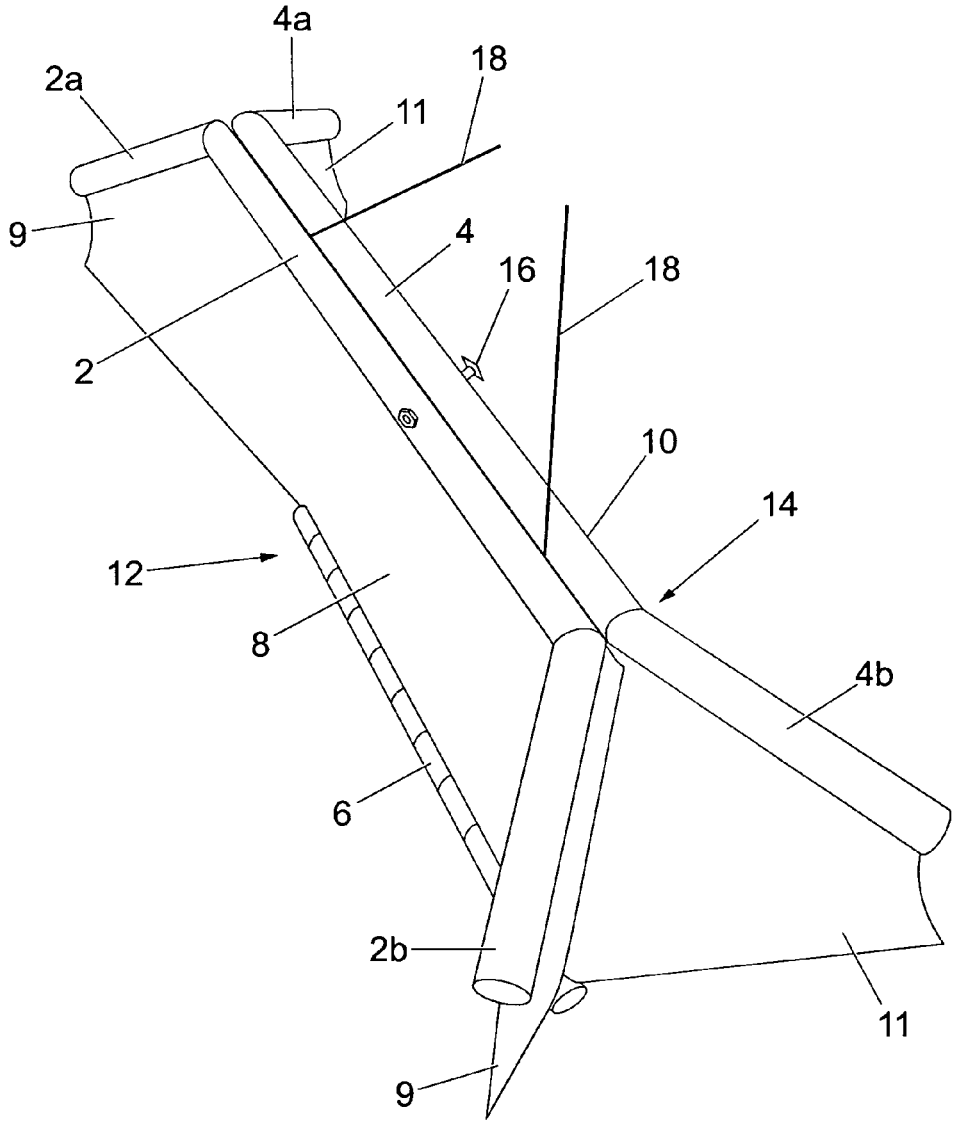
FIG. 1 shows a projected view of a protective subsea structure, in accordance with the present invention, being lowered towards the seabed.
Figure 2:
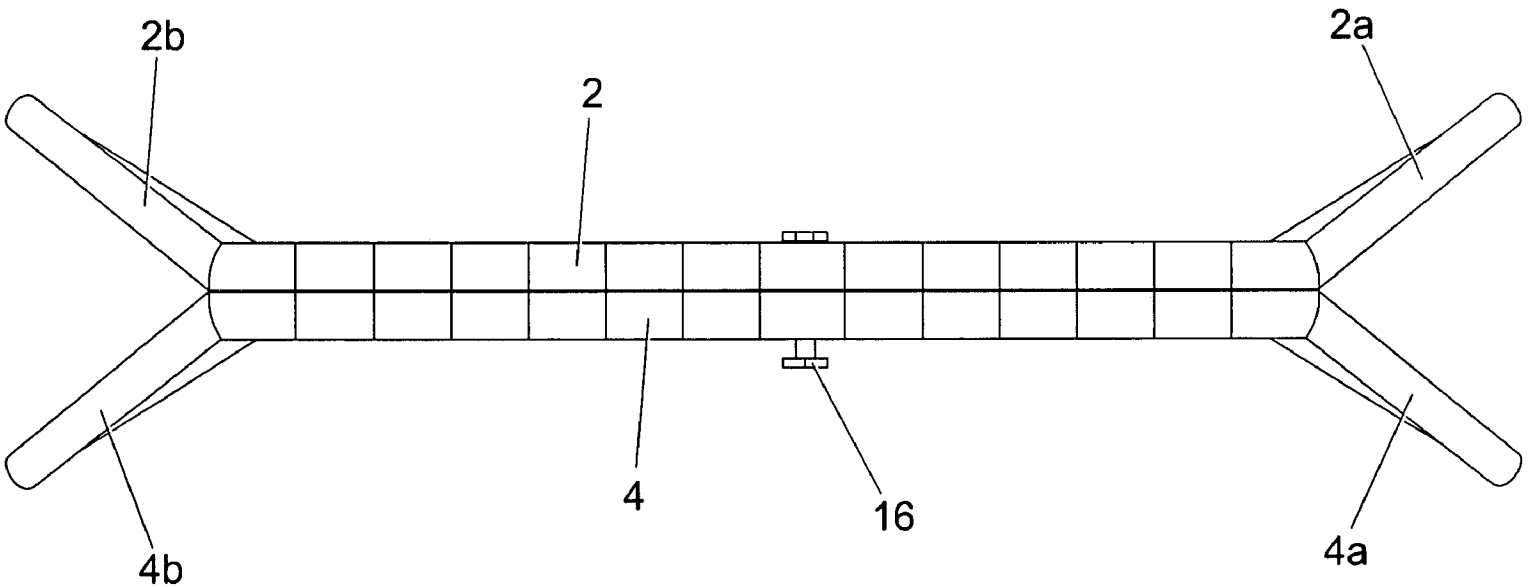
FIG. 2 shows a plan view of the structure of FIG. 1; and c)

FIG. 1 shows the protective structure in the process of being lowered to the seabed. The structure has a folded state and an unfolded state. For ease of transportation, the structure is initially fixed in its folded state, which is shown in FIGS. 1 and 2. The structure comprises a tubular framework to which are fixed a number of panels. The tubular framework is made up of first, second and third beam members 2,4,6. The first and second beam members, or base members, 2,4 will form the base of the structure when in use, whilst the third beam member, or hinge member, 6 will form the apex of the structure. As can be seen best in FIGS. 1 and 2, the first and second beam members 2,4 each have first and second ends 2*a*, 4*a*, 2*b*, 4*b* which are formed at an angle to the main portion of the beam members 2,4. Although the respective ends 2*a*, 4*a*, 2*b*, 4*b* of each of the first and second beam members lie in substantially the same horizontal plane as the main portion of the beams, the ends 2*a*, 4*a*, 2*b*, 4*b* project at an angle to the main portions when viewed in plan, as seen in FIG. 2. Each of the beam members 2,4,6 is adapted to act as a hinge. In the preferred embodiment illustrated, each of the hinges is formed by a pipe-in-pipe arrangement, although any other conventional hinge arrangement may be used. The operation of the hinges will be described in more detail below.

To form the shell of the structure, panels are fixed between the beam members 2,4,6. The panels may be manufactured from steel, glass-reinforced plastics, aluminium or the like. The panels are attached to the beam members 2,4,6 such that two body portions, or "half shells", 12,14 are formed, which when brought together form the complete structure. The first half shell 12 is formed by fixing panels between the first and third beam members 2,6, whilst the second half shell 14 is formed by fixing panels between the second and third beam members 4,6. Each half shell 12,14 is formed from a side panel 8,10 and a pair of end panels 9,11. The side panels 8,10 each have a pair of longitudinal edges, one of which is fixed to the third beam member 6 and the other to the respective first or second beam member 2,4 accordingly. In this preferred embodiment, the end panels 9,11 are generally triangular and have one edge fixed to the end 2*a*, 4*a*, 2*b*, 4*b* of the respective first or second beam member 2,4 and another edge fixed to the adjacent lateral edge of the respective side panel 8,10. The remaining edges of each end panel 9,11 are free edges which will abut the corresponding free edges of the end panels of the other half shell when the structure is in the unfolded state. As stated above, the beams and panels are arranged such that the half shells 12,14 ensure that the structure will substantially enclose the installation when in use.

As previously described, the structure is transported in the folded state shown in FIGS. 1 and 2. In order to move into the folded state, the first and second half shells 12,14 are pivoted upwards of the third beam member 6 about its hinge. In this state, the first and second beam members 2,4 lie adjacent one another and the side panels 8,10 of the half shells 12,14 lie substantially parallel to one another. The first and second beam members are then locked together by a quick-release locking means 16. The locking means 16 in this preferred embodiment is a bolt and pin arrangement, although any other conventional quick-release arrangement can be used in its place. Preferably, whichever quick-release arrangement is used, it can be locked/ released by an ROV. The structure will remain in this folded state during transportation to the installation site, and also whilst being lowered to the seabed. To transfer the structure from a transportation vessel to the seabed, a two-legged sling (not shown) is attached to the third beam member 6, and passes up between the locked first and second beam members 2,4. This allows beam members 2,4 to rotate outwards about hinge 6, once the locking means 16 has been released.

The purpose of transporting the structure in its folded state is to allow easier transportation and installation than conventional protective subsea structures. As shown in FIG. 2, thanks to the vertical side panels 8,10 lying substantially parallel in the folded state, the surface area, or water plane area, of the structure lying in the substantially horizontal plane, and therefore exposed to hydrodynamic forces when being inserted into and also when being lowered through the water, is greatly reduced over not only conventional fixed structures but also known variable geometry arrangements as well. This shape also means that the structures may be conveniently stacked upon or next to one another during transportation, thus taking up far less deck area on the supply vessel.

Figure 3:
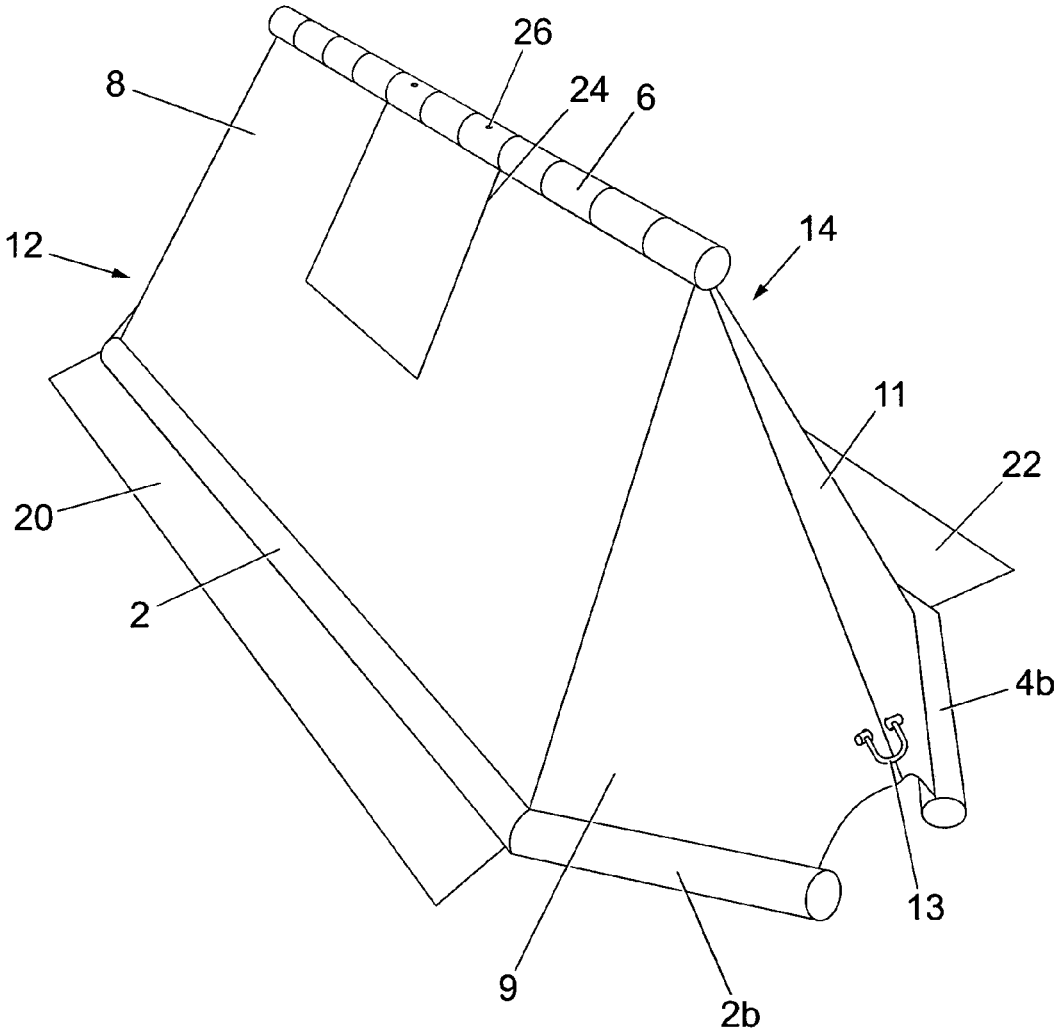
FIG. 3 shows a projected view of the structure once it is positioned over the installation on the seabed.

FIG. 3 shows the structure in its closed state once installed at the seabed. As can be seen, because of the ends 2*a*, 4*a*, 2*b*, 4*b* of the first and second beam members 2,4 projecting inwardly towards the centre of the structure and the provision of both side and end panels 8,9,10,11, the two half shells 12,14 swing together about the hinge on the third beam 6 to form a substantially enclosed tent-like structure. Although not visible in FIGS. 1 and 2, the first and second beam members 2,4 are each provided with a hinged plate member 20,22 which pivots about the beam 2,4. The plate members 20,22 act as stabilisers, more commonly known as "mud mats", and fold out from the closed structure into the deployed positions shown in FIG. 3. The plates 20,22 prevent the structure from sinking into the sediment on the seabed. In order to hold the structure in place, ballast such as rocks may be added on top of the plates 20,22 once they are folded out into position. If access will be required to the protected installation once the structure is in place, one or more closable access openings may be provided in the panels of the structure. In the illustrated embodiment, an access door 24 is provided on the side panels 8,10. The door 24 also replaces part of the third beam member 6. The door 24 is normally locked in place on the structure using a conventional locking means (not shown). When access to the installation is required, the door is unlocked and a sling (not shown) is attached to one or more attachment points 26 on the door. The door 24 can then be lifted away from the structure using a surface crane. Once work is finished on the installation the door 24 is replaced and locked back in position. The locking/unlocking and sling attachment operations may be carried out either by a support diver or else by a remotely operated vehicle (ROV) controlled from a vessel on the surface.

To install the structure, it is supplied to the surface vessel with the first and second slings 18 already passed between the beam members 2,4 and attached to the beam member 6.

A crane on the vessel can then lift the structure into the water in its folded state and lowers the structure to the seabed. Different aspects of the structure being lowered through the water are shown in FIGS. 1 and 2. The structure is lowered to the location of the installation, which will be lying on the seabed. When the structure lies several metres above the installation, the lowering operation will temporarily stop. At this point, an ROV will remove the quick-release locking means 16.

With the hinged beam 6 still held by first sling, the release of the locking means 16 causes the two half shells 12,14 of the structure to fall about the hinge 6 into the closed state shown in FIG. 3, where the free edges of the end panels 9,11 abut one another. Once it has been established that the structure is in the unfolded position, the two halves are locked together 13 and the structure is finally lowered over the installation until the structure rests completely on the seabed, substantially enclosing the installation. The plate members 20,22 can then be folded out from the structure to add stability. Finally, the first sling is removed from the beam 6—now forming the apex of the closed or unfolded structure—and lifted to the surface. The structure now encloses and protects the installation on installation on the seabed from any potential subsea hazards. the seabed from any potential subsea hazards.

With the arrangement of embodiments of the present invention, a number of advantages are provided over existing protective subsea apparatus. Firstly, when protective structure is in the folded state, a number of these may be stored either on top of one other or else alongside one another. Therefore, a number of the structures may be transported by a vessel at the same time in, effectively, a "flat-packed" arrangement. This allows the vessel to install a number of the structures without needing to make individual return trips to shore for each installation.

Furthermore, thanks to the configuration of the embodiments when in the folded state, the surface area of the structure exposed to hydrodynamic forces during launch throughout the air/sea interface and when being lowered to the seabed is also significantly reduced. This means that the structure is easier to deliver to the seabed and also can be delivered in worse weather conditions than with known structures.

Finally, the embodiments are configured so that substantially full enclosure of the installation is achieved. This means that there are no access openings which could be entered by subsea hazards. If access is required at any time, one or more access panels can be removed as necessary. In addition, as the structure uses panels instead of grilles or mesh covers, the likelihood of something snagging on the structure is also reduced.

In order to prevent damage to the two shells when they are released from the open state, a friction mechanism can be employed to slow the fall of the half shells into the closed state. For example, a wire running through a friction clamp could be attached to each shell during the folding of the shells into the closed state. Alternatively, a special rigging arrangement could be employed for this purpose.

Furthermore, the structure could be installed using only one sling attached to the first and second beams. In this case, the unfolding of the half shells would occur on the seabed so as to control the unfolding procedure. Once unfolded, the structure can be lifted from the seabed until the two halves come together in the closed state and are locked 13 to form the structure that can then be placed over the installation as normal. A further alternative method would be to lay the "open" structure on its side on the seabed, unlock the two half shells from one another, and then rotate the uppermost half shell through 180 degrees until it too lies on the seabed. The structure can then be lifted from the seabed and installed in the manner previously described.

Although the access door illustrated in the preferred embodiment is shown located at the top of the closed structure, it should be understood that a door or doors may be located at any appropriate location. The location of the doors will simply depend on the location of the components to which access is required on the subsea installation.

These and other modifications and improvements may be incorporated departing from the scope of the present invention.

The invention claimed is:

1. A protective structure for a subsea installation, the structure comprising first and second body portions and a hinge member, wherein the body portions are pivotally mounted to each other via the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein both first and second body members share the same hinge member and wherein each body portion comprises a base member and at least one side panel.

2. A protective structure according to claim 1, wherein the first configuration comprises a folded state and the second configuration comprises an unfolded state.

3. A protective structure according to claim 2, wherein both body portions rotate relative to one another when the structure moves from the folded state to the unfolded state.

4. A protective structure according to claim 1, wherein each body portion comprises a base member and at least one side panel.

5. A protective structure according to claim 1, wherein the structure includes at least one second locking means for locking the first and second body portions together when the structure is in the unfolded state.

6. A protective structure according to claim 1, wherein the structure is adapted to be stored and transported in the folded state.

7. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein at least one side panel has a pair of longitudinal edges, and wherein one of the longitudinal edges is fixed to the base member and the other longitudinal edge is fixed to the hinge member.

8. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein each base member has first and second end portions at respective ends thereof, the first and second end portions being arranged so as to project inwardly from the base member towards the centre of the structure when the structure is in the unfolded state.

9. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein each body portion comprises first and second end panels, each of which first and second end panels is fixed to a respective lateral edge of the at least one side panel.

10. A protective structure according to claim 9, wherein each end panel has a free edge and the body portions are arranged such that the free edges of the end panels of the respective body portions abut one another when the structure is in the unfolded state.

11. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein each base member has a hinged stabiliser plate pivotally attached thereto, each plate being arranged to move from a retracted position to a deployed position.

12. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein at least one of the body portions has a closable access opening adapted to allow access to the interior of the structure when the structure is in the unfolded state.

13. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein the base members lie adjacent one another when the structure is in the folded state.

14. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein the side panels lie substantially parallel to one another when the structure is in the folded state.

15. A protective structure for a subsea installation, the structure comprising first and second body portions and a hinge member, wherein the body portions are pivotally mounted to the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein each body portion comprises a base member and at least one side panel, wherein the structure includes a first locking means for locking the base members together when the structure is in the folded state.

16. A method of protecting a subsea installation, comprising the steps of:

a) pivotally mounting first and second body portions to each other via a hinge member, such that the first and second body members share the same hinge member, to form a structure wherein at least one of the body portions may rotate relative to the other body portion from a first configuration which facilitates transportation and/or deployment to the seabed, and a second configuration and wherein each body portion comprises a base member and at least one side panel;

b) locking the first and second body portions together such that the structure is in the first configuration;

c) lowering the structure in the first configuration to a position adjacent the seabed;

d) rotating the first and second body portions about the shared hinge member from the first configuration to the second configuration;

e) locking the structure in the second configuration; and f) lowering the structure in the second configuration over the installation such that the installation is substantially enclosed by the structure.

17. A method according to claim 16 wherein the first configuration comprises a folded state and the second configuration comprises an unfolded state.

18. A method according to claim 16, wherein step f) occurs before step e).

19. A protective structure for a subsea installation, the structure comprising first and second body portions and a hinge member, wherein the body portions are pivotally mounted to each other via the hinge member such that at least one of the body portions may pivot relative to the other body portion from a first configuration which facilitates transportation and/or deployment to the seabed and a second configuration in which the body portions are arranged to substantially enclose the subsea installation when the structure has been positioned over it, wherein both first and second body members share the same hinge member and wherein at least one of the body portions has a closable access opening adapted to allow access to the interior of the structure when the structure is in the unfolded state.

* * * * *

UNITED STATES PATENT AND TRADEMARK OFFICE

CERTIFICATE OF CORRECTION

PATENT NO. : 7,070,360 B2
APPLICATION NO. : 11/046920
DATED : July 4, 2006
INVENTOR(S) : Ellingsen It is certified that error appears in the above-identified patent and that said Letters Patent is hereby corrected as shown below:

Column 6, Claim 1, line 25, after body, change “members” to --portions--.

Column 6, Claim 4, lines 34-36, delete claim 4 in its entirety.

Column 6, Claim 5, line 40, change “unfolded state” to --second configuration--.

Column 6, Claim 6, lines 42-43, change “folded state” to --first configuration--.

Column 7, Claim 8, lines 5-6, change “unfolded state” to --second configuration--.

Column 7, Claim 10, line 25, change “unfolded state” to --second configuration--.

Column 7, Claim 12, lines 51-52, change “unfolded state” to --second configuration--.

Column 7, Claim 13, line 65, change “folded state” to --first configuration--.

Column 8, Claim 14, line 11, change “folded state” to --first configuration--.

Column 8, Claim 15, line 24, change “folded state” to --first configuration--.

Column 8, Claim 16, line 29, after body, change “members” to --portions--.

Column 8, Claim 19, line 65, change “unfolded state” to --second configuration--.

Signed and Sealed this

Eighth Day of July, 2008

JON W. DUDAS
*Director of the United States Patent and Trademark Office*